United States Patent [19]

Raditic

[11] Patent Number: 4,822,040

[45] Date of Patent: Apr. 18, 1989

[54] BOWLING TRAINING PROCESS AND DEVICE

[76] Inventor: Thomas F. Raditic, 95 Ashland Ave., Buffalo, N.Y. 14222

[21] Appl. No.: 179,971

[22] Filed: Apr. 11, 1988

[51] Int. Cl.[4] ..... A63D 5/00

[52] U.S. Cl. ..... 273/54 D; 434/249

[58] Field of Search ..... 273/54 D, 184 A, 185 R; 434/249

[56] References Cited

U.S. PATENT DOCUMENTS 3,252,705 5/1966 Cornberg ..... 273/54 D
3,411,789 11/1968 Wariner ..... 273/186 D
4,247,100 1/1981 Barbee ..... 273/54 D

FOREIGN PATENT DOCUMENTS 3044160 6/1982 Fed. Rep. of Germany ... 273/54 D

*Primary Examiner*—Anton O. Oechsle
*Attorney, Agent, or Firm*—James J. Ralabate

[57] ABSTRACT

A target sheet for use on a bowling lane and a method of training a bowler. The target sheet comprises pressure-sensitive microscopic capsules adapted to create a visible image when applying pressure thereon. Aligning indicia on one side of the sheet is used to provide reference points to gauge a ball's trajectory thereover and to align the sheet with boards on the lane. The second side of the sheet is provided with an adhesive adapted to fix the sheet to a bowling lane. The method involves fixing the sheet to a bowling lane, rolling a ball thereover, and comparing the image formed by the ruptured capsules with the reference points to determine the lane board corresponding to the image.

10 Claims, 2 Drawing Sheets

BOWLING TRAINING PROCESS AND DEVICE

The present invention relates to bowling and, more particularly, to a process and device for training and assisting bowlers to improve their game.

BACKGROUND OF THE INVENTION

There are known various means to assist bowlers to improve their game. In one such method, a bowler aims his ball at various points or marks on an alley and attempts to recall and duplicate this path on subsequent balls thrown. Recalling this path can be difficult and frustrating and involves a great deal of memory practice and concentration. There is no permanent record of the previous ball thrown to help guide the bowler on the subsequent ball to be thrown. To assist in this training process various means have been suggested. In U.S. Pat. No. 4,247,100 issued to Barbee, an electronic bowling ball tracking device is disclosed. In Barbee's invention a focused light source is superimposed over the spotting portion of a bowling alley. A photoelectric switch circuit having a plurality of photoelectric cells responsive to light is used, the light source being disposed in transverse rows at intervals along the bowling alley. Controlling lamps on a display are also used. The illuminated display may also include conventional displays showing location of standing pins. Barbee's device also can include multiple point references wherein several photoelectric observations are displayed on the display map. While a system like Barbee's is useful, it requires a substantial expense to install and use in a bowling alley. Also, anything that diverts the bowler's attention from his game is counterproductive and undesirable. While training means such as electronic means can be used, they present a deviation from the natural feel of the alley and require some adjustments or modifications in the bowling alley to be useful. It would be very desirable to have a training device and process that would not interfere with the natural feel or looks of an alley and provide the bowler with the familiar feel of the alley. Thus, electronic gadgetry or complex equipment is not consistent with a conventional bowling alley.

SUMMARY OF THE INVENTION

It is therefore an object of this invention to provide a bowling training process and device devoid of the above-noted disadvantages.

Another object of this invention is to provide an easy to use bowling training system adapted for use on any existing bowling alley.

Yet another object of this invention is to provide an economical and efficient method of training bowlers or method for improving a bowler's game.

Still a further object of this invention is to provide a process for permanently recording the trajectory of a bowling ball so that subsequent trajectories can be compared therewith.

Still yet a further object is to provide a bowler tracking process and device that uses existing materials and thus is comparatively economical to use.

Yet still another object of this invention is to provide a training method and target sheet device that is adapted for use in existing bowling alleys without any need for expensive modifications.

Another still further object of this invention is to provide a training method and device which clearly and immediately indicates the ball's trajectory so that appropriate modifications or adjustments to the trajectory can be easily accomplished.

A still further object of this invention is to provide a novel target sheet for use in training bowlers to improve their game.

These and other objects of this invention are accomplished generally speaking by a training system, process and device comprising the following. A paper sheet such as N.C.R. encapsulated ink papers having pressure-sensitive materials therein are used. The N.C.R. Corporation identifies their paper (and the paper preferred in the present invention) as No. 17 white 64 $G/M^2$ black print paper. Suitable pressure-sensitive ink encapsulated papers used in the present invention are of the type described in a brochure "Printing and Using N.C.R. Paper-brand of carbonless paper Technical Guide", by Appleton Papers Inc. "N.C.R." and "N.C.R. Paper" are registered trademarks of NCR Corporation. Appleton Papers Inc. is a mark of Appleton Papers Inc. of P.O. Box 359, Appleton Wisc. 54912. These papers provide a permanent visible image of the trajectory of a bowling ball rolled over it. When encapsulated ink papers are indicated in this disclosure it is intended that the papers in this publication are used. On the upper face of this pressure-sensitive sheet are columns or lines that are the approximate width of the boards on a conventional bowling alley lane. These lines are parallel to the lateral sides of the paper and provide convenient reference points to the balls' recorded trajectory. On the back side of the tracking paper is an adhesive or tape which is used to fix the paper to the bowling surface of the bowling lane. A preferred tape to be used is made by the 3-M Corporation and is identified as a film tape coated on one side with a high-tack pressure-sensitive adhesive and on the other side with low-tack (removable) pressure-sensitive adhesive. This adhesive tape is further identified as having a high-tack acrylic adhesive A-40 and a low tack acrylic A-5. Any suitable tape peel-off adhesive may be used, however, the above-described 3-M film tape is preferred.

The training process and target sheet device of this invention provides both a target and recording means which is able to permanently record the movement of a bowling ball as it passes over the encapsulated ink pressure-sensitive surface. To use the paper device of this invention, one simply removes the backing off the tape and fixes the paper to the bowling surface. When the paper is fixed, one would find the desired line to the pocket (of pins) and fix the paper in the path of this line. Then, after each ball is rolled over it, a clear identifiable line is produced on the surface of the paper. This line can then be marked ball 1 and subsequent lines ball 2, ball 3 etc. Ideally, each line would be on top of the other. When a strike is thrown, this line can be clearly marked as the standard and all other lines to the right or left of it can be marked and adjustment made to correct any deviation from this standard line. Also, each paper can be kept from lesson to lesson to gauge the progress made in the lessons. Each sheet can be used as a page in a looseleaf notebook to record the history of a bowler's improvement over a given period of lessons. Various pieces of information can be recorded on the upper face of the sheet such as board numbers, name of bowler, date of lesson, bowling alley, lane used etc. The paper device or sheet used is easy to use, will not damage the lane and will not affect lane conditions.

DETAILED DESCRIPTION OF THE DRAWING AND THE PREFERRED EMBODIMENT

Figure 1:
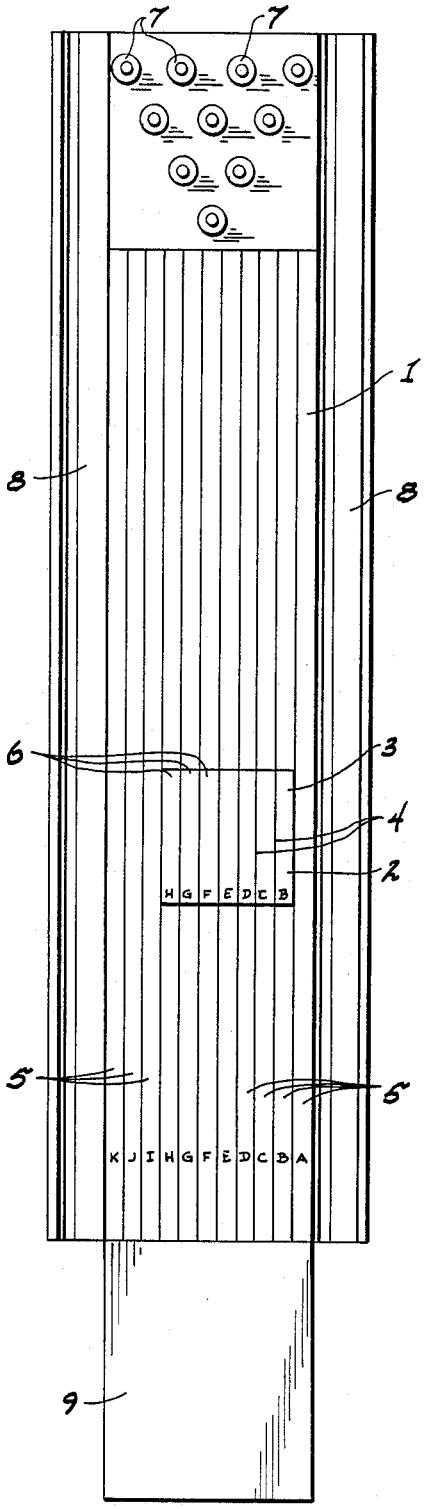
FIG. 1 is a top plan view of a bowling alley with the pressure-sensitive paper device of this invention fixed thereon.

On a conventional bowling alley 1 the target sheet 2 of this invention is fixed at a location in alley 1 in the path of the ball to be thrown. The adhesive strip is removed from the back portion of target sheet 2 and the sheet 2 is removably attached to the lane or alley 1. The top portion 3 of target sheet 2 has vertical lines 4 that are spaced to coincide with the width of boards 5. Each column 6 formed by lines 4 are marked as "board D" or "board E" to correspond to the board aligned with each column 6. For example, in the illustration of FIG. 1, reading from right to left, columns 6 correspond to lane boards B—C—D—E. When the ball rolls over target sheet 2 the trajectory imprint is readable or visible on one or more of columns 6 and can be identified with the corresponding board it travels over. All boards in conventional bowling lanes are substantially the same width; therefore, the target sheet 2 has universal usage. The columns 6 and vertical lines 4 are not only used to align with the corresponding boards A–K but also are used to gauge the location and approach angle of the ball as indicated by the visible image left by the ball that travels thereover. The successful balls thrown that result in strikes can be read out on target sheet 2 and can attempt to be duplicated to improve one's score. Their historical relationship to pins 7 can also be used when several sheets 2 are used to be filed in a looseleaf notebook. For example, if ball travelling over board C knocks over pin 8, this information can be useful in practicing spares, splits, etc.

Figure 2:
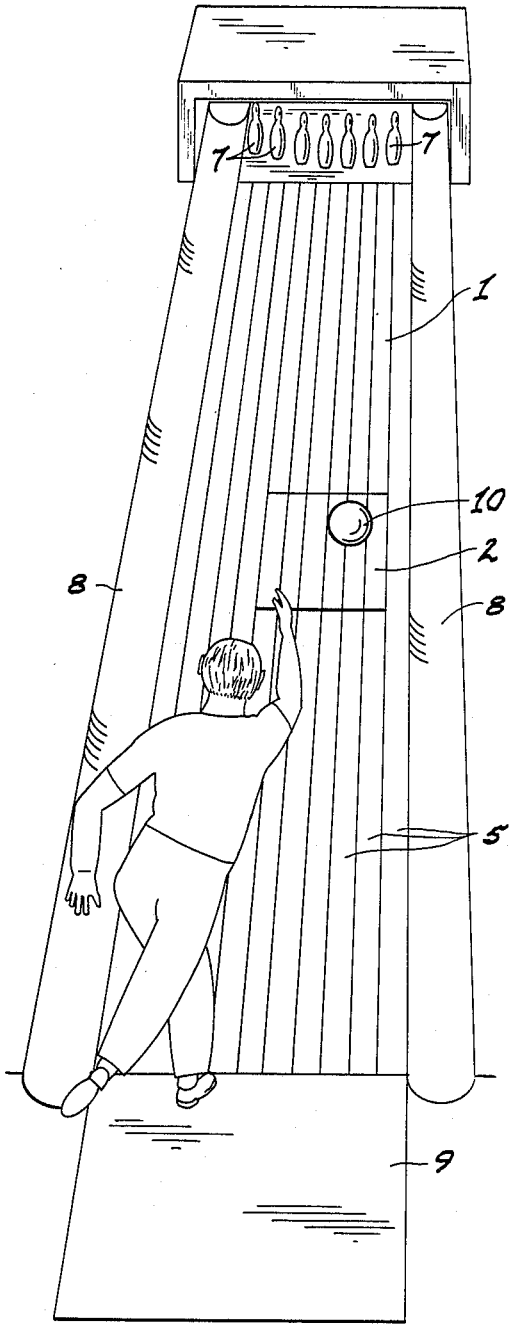
FIG. 2 is a perspective view of a bowling alley with the pressure-sensitive paper device or target sheet fixed thereon as a ball is being moved thereover.

The conventional alley 1 has gutters 8 and approach space 9 as is normal. In FIG. 2 a perspective is illustrated showing the bowler throwing ball 10 over target sheet 2 to thereby imprint the path or trajectory of the ball on the face of sheet 2. Sheet 2 is shown fixed toward the right side of alley lane 1 when a righthanded bowler is using the system of this invention. Sheet 2 would be fixed toward the left side of lane 1 if a lefthanded person was bowling.

Figure 3:
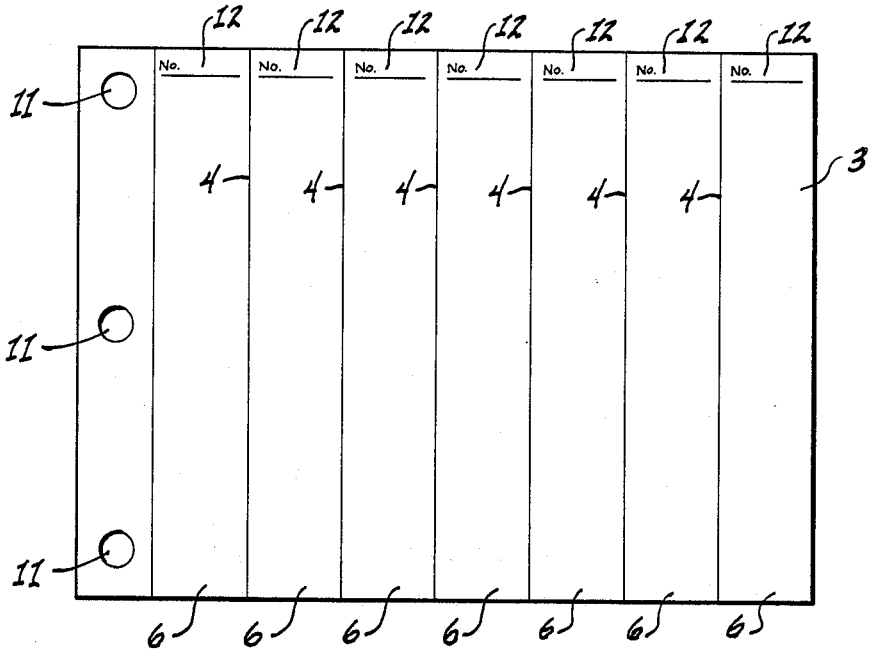
FIG. 3 is a top plan view of the unused encapsulated ink paper or target sheet having information thereon and holes for filing in a looseleaf notebook.
Figure 4:
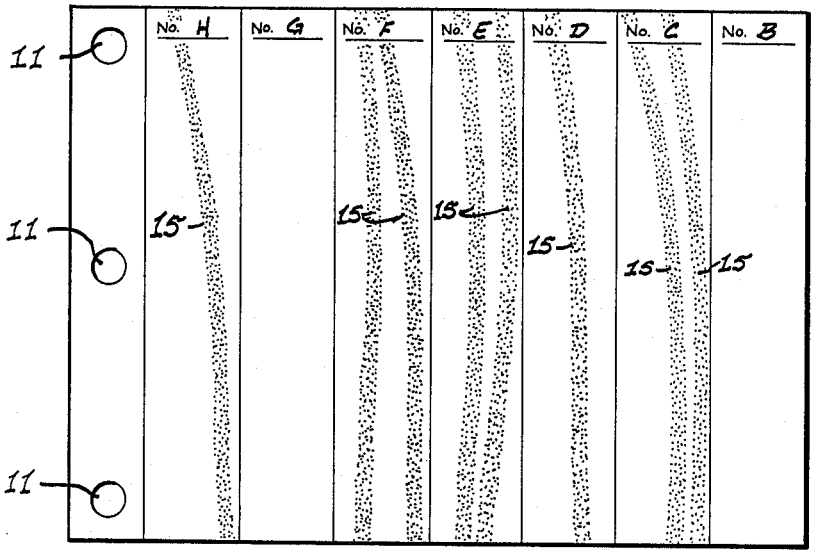
FIG. 4 is a top plan view of a used encapsulated ink paper after a series of bowling balls have been rolled over it.

In FIG. 3 the top surface of face 3 of unused target sheet 2 is illustrated. Each sheet 2 has a series of lines 4 which form vertical columns 6. Each column 6 is approximately the width of each lane board 5 to which it is aligned. At the upper portion of face 3 are spaces 12 for indicating the board number (in this case board letters A–K for clarity). These lines 4 and columns 6 are used as standards from which to measure the approach angle of the ball and the location of the path of the ball 10 which travels thereover. Other information can be put on face 3 such as instructions or how to use target 2, bowler's name, bowling alley establishment, lane number, date, etc. so that an accurate progression of the bowler's lessons can be kept. Punch holes 11 can be provided for convenient filing in a looseleaf notebook. Any size paper sheet 2 can be used having any number of columns 6 depending upon the skill of the bowler. For example, a larger width sheet 2 can be used with beginners having more columns (thus aligned with more boards 5) since there will be a greater variance in the paths of the balls rolled. In FIG. 4 the same target sheet 2 is illustrated except in FIG. 4 the images 15 left by the ball are indicated. The angle of images 15 can can be determined when comparing them with lines 4 and columns 6. Also, as can be seen, two balls rolled over board C, two over board D, two over board E, two over board F and one over board H. If, for example, the balls rolled over board D, or column 6D resulted in strikes, practicing throwing the first ball over board D would result in improving one's game score. Also, if throwing the ball down board H resulted in a spare, knocking the remaining pin down, this same spare can be accomplished later by rolling the ball down board H, etc.

Figure 5:
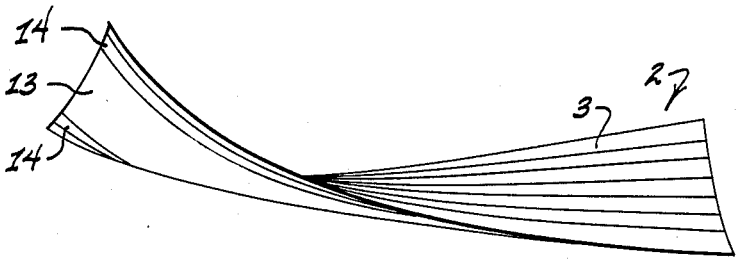
FIG. 5 is a perspective view of the encapsulated ink paper showing partial upper and bottom surfaces of the paper.

In FIG. 5 a perspective of unused target sheet 2 is shown with top face 3 shown partially and bottom face 13 shown partially. On top face 3 vertical lines 4 are seen running through the complete length of the sheet 2. Each column 6 formed by lines 4 will have substantially the same width as conventional floorboards in a conventional bowling lane. On bottom face 13 of target sheet 2 is a strip-off adhesive 14 which also runs vertically through the length of sheet 2. The plastic stripping is stripped off leaving an adhesive exposed. This exposed adhesive is then used to fix target sheet 2 to the bowling lane in the path the ball will likely pass through.

The preferred and optimumly preferred embodiments of the present invention have been described herein and shown in the accompanying drawing to illustrate the underlying principles of the invention, but it is to be understood that numerous modifications and ramifications may be made without departing from the spirit and scope of this invention.

What is claimed is:

1. A target sheet for use on a bowling lane which comprises pressure-sensitive microscopic capsules adapted to create a visible image when applying pressure thereon, said sheet having on one first side aligning means which has two functions, first to gauge a trajectory line of an object passing thereover and also to align said sheet with board numbers on said lane to provide reference points for the ball's trajectory, and said sheet having an adhesive on an opposite second side, said second side adapted to fix said sheet to a bowling lane.

2. The sheet of claim 1 wherein said aligning means are lines on said sheet forming columns which substantially correspond in width to the width of each board in said lane.

3. The sheet of claim 1 wherein said sheet contains apertures along one lateral edge thereof, and wherein said first side contains vertically disposed columns having widths substantially the same as the widths of floorboards in said bowling lane, the reverse side having adhesive means for fixing said target sheet to the floor of said bowling lane.

4. The sheet of claim 1 wherein said opposite second side contains a strip-off adhesive strip.

5. A process for improving the accuracy skills of a bowler which comprises placing a pressure-sensitive target on a lane of a bowling alley, fixing said target in place on said alley, providing on said target visible markup for comparing the trajectory of a bowling ball rolled thereover, rolling a bowling ball down the alloy in such a manner that it passes over said pressure-sensitive target thereby substantially permanently recording on said target the ball trajectory, locating the proper visible trajectory image for maximum score, and comparing that same trajectory with the next ball and series of balls thrown.

6. The process of claim 5 wherein said pressure-sensitive target has indicated thereon said visible markings, aligning these markings with floorboards in said bowling alley, rolling a bowling ball thereover, and subsequently comparing the image formed by the ball with said markings to determine thereby the path of the ball rolled thereover.

7. The process of claim 5 wherein said pressure-sensitive target has indicated thereon vertical columns, aligning these columns with floorboards in said bowling alley, and after rolling a bowling ball thereover, comparing the image formed thereby with said vertical columns to determine both the path and the angle of the ball approach which passes thereover.

8. The process of claim 5 wherein said pressure-sensitive target is fixed in place by an adhesive located on the bottom surface of said target.

9. The process of claim 5 wherein said pressure-sensitive target is an encapsulated ink paper wherein capsules therein are broken by the pressure of the ball rolling thereover to form thereon a visible image.

10. A method for training a bowler to improve his or her score which comprises locating the probable path of a ball to be thrown in an alley, placing a target sheet in said path and fixing it in place, providing in said target encapsulated ink means capable of rupturing upon exertion of pressure thereon, providing on the upper surface of said target visible markings, aligning said markings with at least one floorboard on said alley, rolling a bowling ball over said target thereby substantially permanently forming a visible image, and comparing said image with said visible, markings to determine the board corresponding to the image, and gauging the subsequent ball to be thrown by the location of image formed by the first ball.

* * * * *